US012539944B2

(12) United States Patent
Pedigo

(10) Patent No.: US 12,539,944 B2
(45) Date of Patent: Feb. 3, 2026

(54) COLLAPSIBLE KAYAK

(71) Applicant: Alec Josiah Pedigo, San Antonio, TX (US)

(72) Inventor: Alec Josiah Pedigo, San Antonio, TX (US)

( * ) Notice: Subject to any disclaimer, the term of this patent is extended or adjusted under 35 U.S.C. 154(b) by 670 days.

(21) Appl. No.: 17/963,636

(22) Filed: Oct. 11, 2022

(65) Prior Publication Data

US 2023/0115173 A1 Apr. 13, 2023

Related U.S. Application Data

(60) Provisional application No. 63/253,727, filed on Oct. 8, 2021.

(51) Int. Cl.
*B63B 34/23* (2020.01)

(52) U.S. Cl.
CPC ..... *B63B 34/23* (2020.02)

(58) Field of Classification Search
CPC ..... B63B 34/00; B63B 34/20; B63B 34/21; B63B 34/23; B63B 2007/006
USPC ..... 114/343, 347, 352, 354, 61.27
See application file for complete search history.

(56) References Cited

U.S. PATENT DOCUMENTS

| | | | | |
|---|---|---|---|---|
| 2,666,933 | A * | 1/1954 | Engensperger | B63B 34/00 114/77 R |
| 6,729,260 | B2 * | 5/2004 | Elvestad | B63B 7/06 114/354 |
| 7,568,444 | B2 * | 8/2009 | Espeseth | B63B 34/23 114/352 |
| 7,854,211 | B2 | 12/2010 | Rixford | |
| 7,963,243 | B2 * | 6/2011 | Quigley | B63B 34/23 114/352 |
| 8,316,788 | B2 | 11/2012 | Willis | |
| 10,577,055 | B1 | 3/2020 | Kirk | |
| 2004/0011275 | A1 * | 1/2004 | Broom | B63B 34/23 114/354 |
| 2008/0121166 | A1 | 5/2008 | Yaron | |

OTHER PUBLICATIONS

Pakayak, Retrieved from Internet, Retrieved on Sep. 17, 2021 <URL: https://pakayak.com/why-choose-pakayak/>.

* cited by examiner

*Primary Examiner* — Daniel V Venne

(57) ABSTRACT

A kayak having a main body and at least one telescoping extendable insert. The extendable insert can expand out of and collapse into the main body of the kayak, allowing for the kayak to be more compact for storage and transport. The telescoping extendable inserts of the kayak latch into place when the kayak is fully extended. An automatic spring-loaded catch mechanism helps secure the telescoping extendable inserts in place before they are latched together by the user.

18 Claims, 6 Drawing Sheets

COLLAPSIBLE KAYAK

FIELD OF THE INVENTION

The present invention generally relates to water sport equipment. More specifically the present invention relates to a kayak, that is both portable and collapsible. The kayak is modular, and it may be collapsed from both ends allowing the user to transport the assembly easier by downsizing the assembly.

BACKGROUND OF THE INVENTION

People have been practicing water sports as a leisure activity for years. Generally, water sports are divided into three major categories, in-water sports, on-water sports, and under-water sports. Kayaking is an example of on-water sport that allows users to cover large distances on water bodies. Various types of kayaks have been developed, each with various options. Furthermore, people have the option to customize their kayak depending preference and the type of water environment where the kayak will be used. As an example, recreational kayaks are designed mostly for flat-water paddling, with integrated features that provides stability and control for the user. On the other hand, kayaks that are used in whitewater river environments must be able to withstand running rapids, and further integrate the use of impact resistant materials, with higher sides to minimize splashing. Kayaks are sized accordingly to best fit the user, and as such the scale of the hull is adapted accordingly. Regardless of the scale of the kayak, or the individual features of each model, the overall combination of components remains largely the same. A common problem with traditional designs however, is the challenging task of transporting the kayak. While the weight of the kayak is not always an issue, since most kayaks are lightweight the sheer size of a kayak may be cumbersome to transport onto a vehicle, especially when the user has a compact automobile.

The present invention aims to solve this issue by providing a kayak having extendable inserts. In the ideal embodiment, the extendable inserts can extend out from the main body of the kayak when the kayak is in use, such as with a telescoping design. When the user finishes using the kayak, the extendable inserts can be collapsed back into the main body, allowing the kayak to much more easily be transported, saving greatly on space. As such, the present invention solves the problem of cumbersome transportation typically associated with traditional kayak designs. By collapsing the extendable inserts, the kayak is reduced to only the general size of the main body or cockpit of the kayak, which is much easier to transport and carry.

DETAIL DESCRIPTIONS OF THE INVENTION

Figure 1:
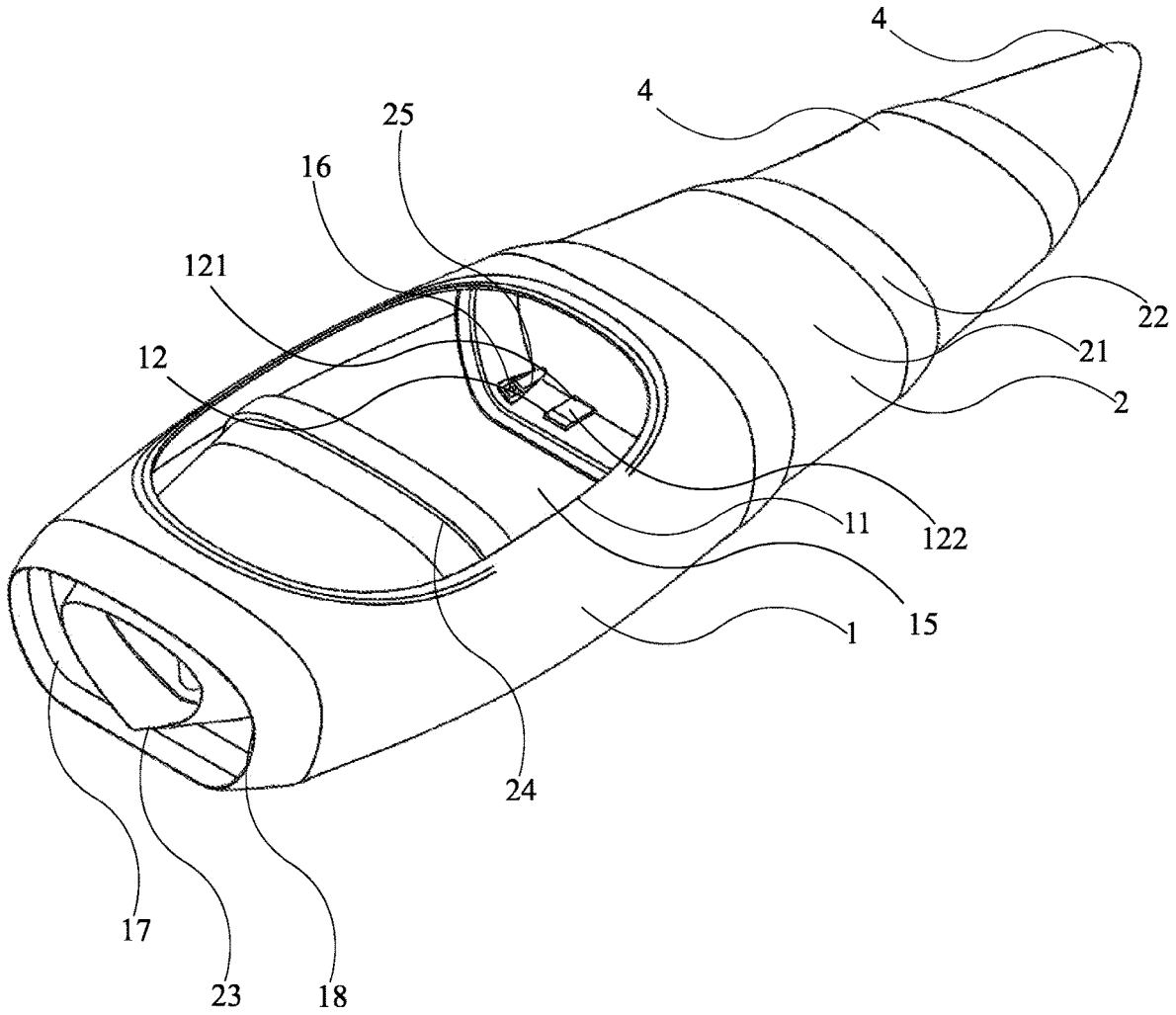
FIG. 1 shows a perspective view of the present invention with one side of the collapsible kayak collapsed, and the other extended.

All illustrations of the drawings are for the purpose of describing selected versions of the present invention and are not intended to limit the scope of the present invention.

The present invention is a collapsible kayak comprising a main body 1, an extendable insert 2, and a plurality of accessories. The main body 1 of the kayak further comprises a top opening 11, a side opening 18, a hatch 12, and a cockpit area 15. The extendable insert 2 further comprises a midsection 21, an end section 22, an insert opening 23, a ridge 24, a spring-loaded automatic catch 25, a locking mechanism 26, an external flap 27, a handle, and a mounting bracket. The accessories are intended for alternate embodiments of the present invention, and can include ports for attachment of various devices, toggles, and mounts through which to attach tow ropes and other accessories.

Referring now to the figures, as seen in FIG. 1-5, the main body 1 of the kayak first comprises a top opening 11. The top opening 11 is located on the top of the kayak. The top opening 11 leads into a cockpit area 15 that encompasses the user-area of the kayak, the cockpit area 15 being intended to provide an area for the user to sit. The use of a seat is contemplated by alternate embodiments. The seat may be positioned centrally to the cockpit area 15 in the ideal embodiment, though other embodiments contemplate alternate placements of the seat, or the use of more than one seat in the main body 1 of the kayak.

The main body 1 further comprises a hatch 12. The hatch 12 comprises an enclosure 121 and a lid 122. The enclosure 121 is a hollow space that is intended to allow the user to store valuable items, such as a wallet or electronics. For this reason, the lid 122 and the enclosure 121 are waterproofed to allow these goods to be safely stored in the enclosure 121 without risk of water damage.

In an alternate embodiment of the present invention, the main body 1 contains an indent 16 for use with a spring-loaded catch mechanism. The indent 16 on the main body 1 provides a small groove or channel that is sized to accommodate the spring-loaded catch mechanism 25. When the user pulls out the extendable insert 2, the spring-loaded catch would press into the indent 16, stabilizing the kayak while the user can engage the locking mechanism 26. The use of a plurality of indents 16 and a plurality spring-loaded catch mechanisms 25 is contemplated by the present invention.

The present invention further comprises an extendable insert 2. The extendable insert 2 is a telescoping section of the kayak that can slide in and out from the main body 1. The extendable insert 2 comprises a midsection 21, an end section 22, and an insert opening 23. In the ideal embodiment, the end section 22 is narrower than the midsection 21. In the ideal embodiment, the extendable insert 2 is sized to press-fit into the main body 1 of the kayak. When the user wishes to use the kayak, they can grab a handle located on the extendable insert 2 and pull the extendable insert 2 out from the main body 1. When the extendable insert 2 is fully extended, a ridge 24 on the extendable insert 2 will catch on a lip 17 located on the main body 1 of the kayak, preventing the extendable insert 2 from falling out of the kayak. In the ideal embodiment, the extendable insert 2 has an insert opening 23 on one side, and is tapered into a point on the opposite side.

In the ideal embodiment, the ridge 24 on the extendable insert 2 further comprises a seal 241. The seal 241 is ideally an O-Ring seal 241 made out of rubber. The seal 241 is positioned radially around the ridge 24 of the extendable insert 2, closing the gap created between the main body 1 and the extendable insert 2. As the kayak is modular, the seal 241 is integrated to ensure the assembly is waterproof, and able to maintain buoyancy at all times. Other sealing mechanisms are considered contemplated by the present invention, such as making the seal 241 out of different material or positioning the seal 241 different, so long as the present invention remains waterproofed.

Figure 2:
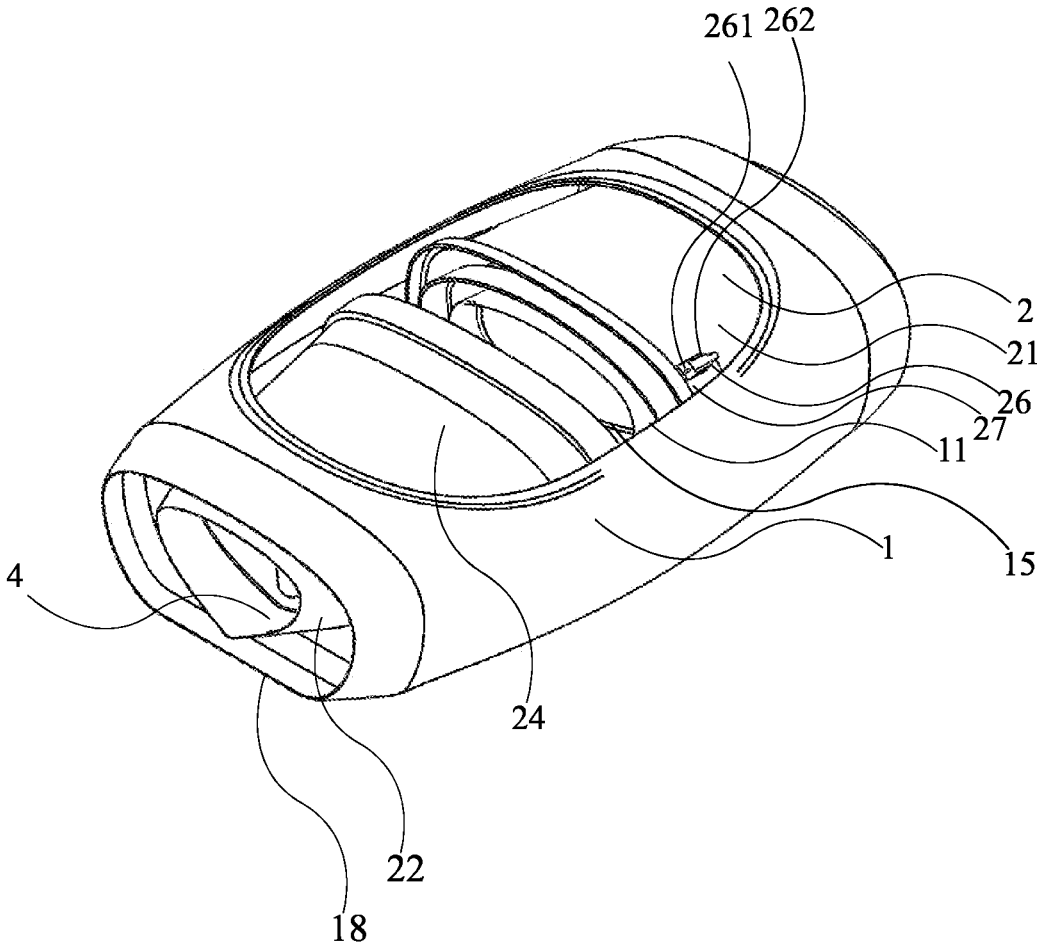
FIG. 2 shows a perspective view of the present invention in a fully collapsed state.
Figure 3:
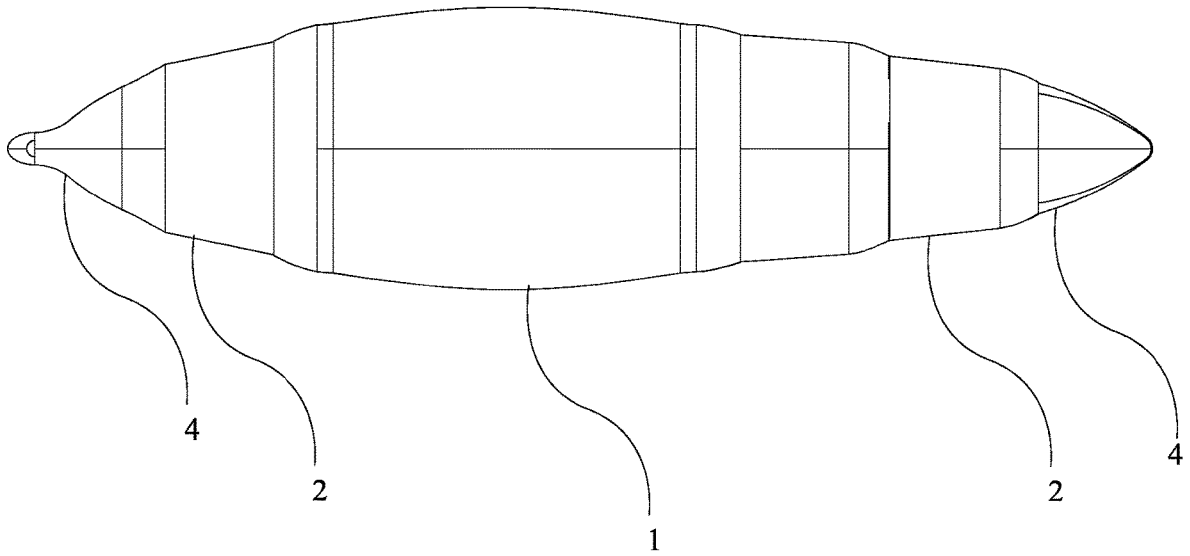
FIG. 3 shows a bottom view of the present invention in an extended state.
Figure 4:
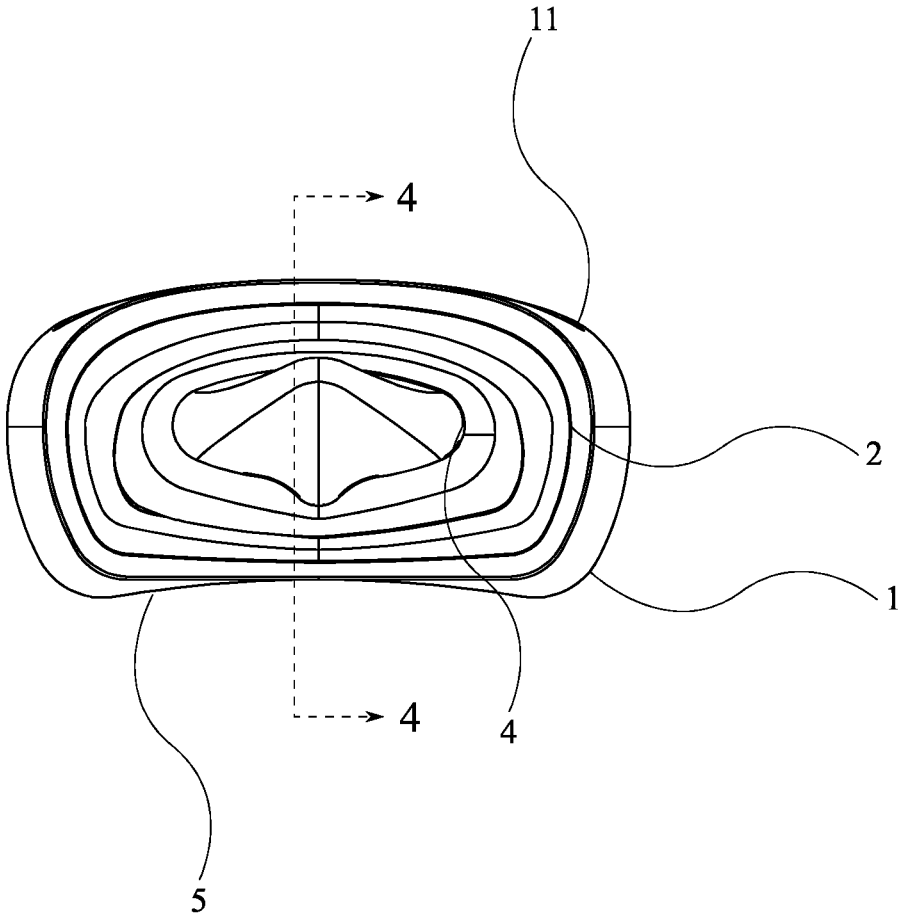
FIG. 4 shows a front view of the present invention.
Figure 5:
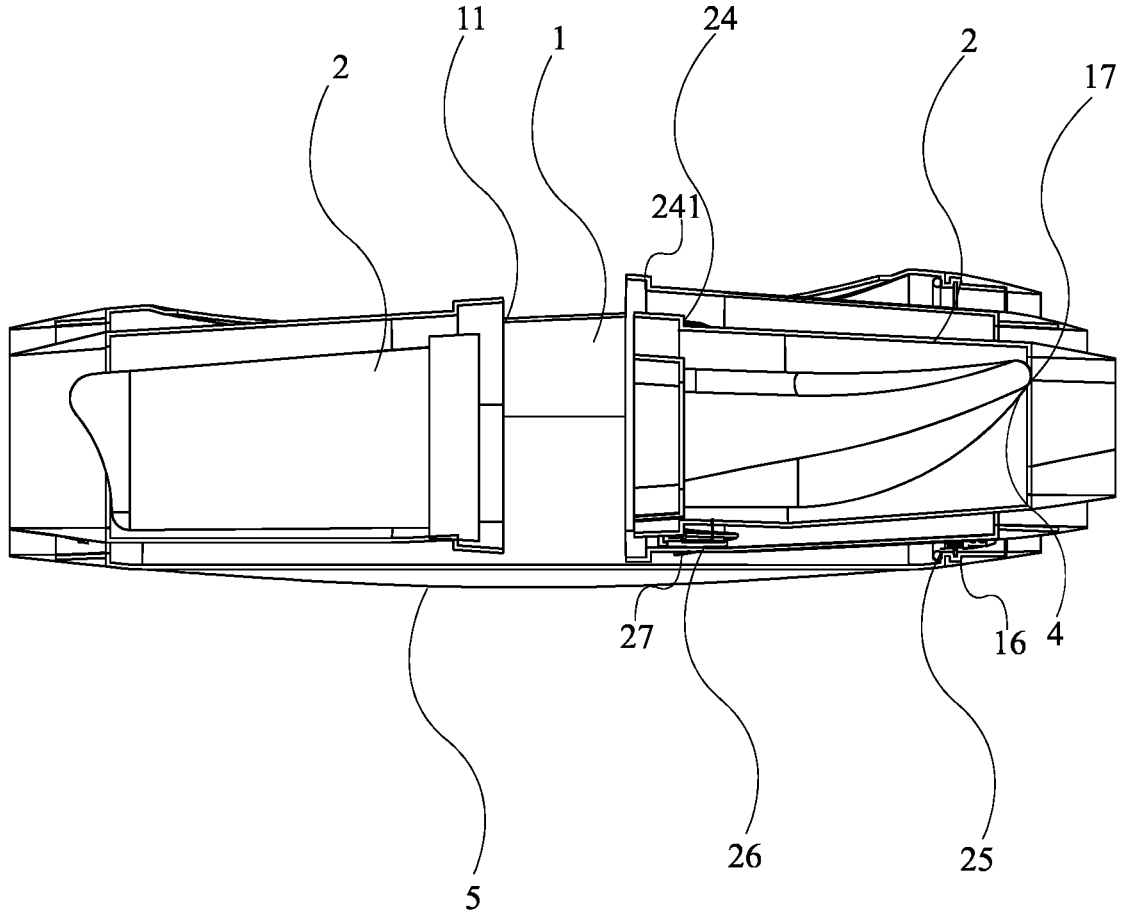
FIG. 5 shows a sectional view of the present invention taken along line 4-4 from FIG. 4.
Figure 6:
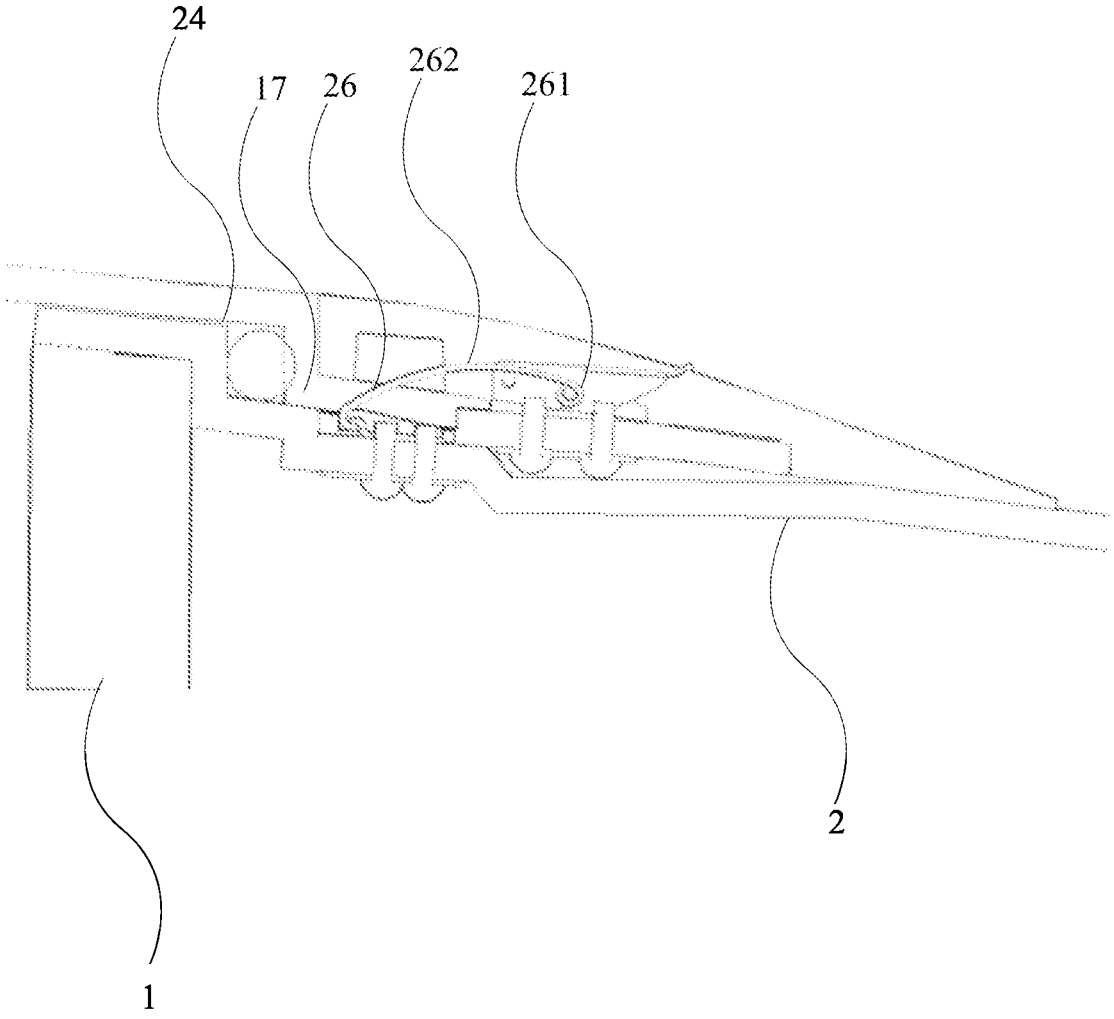
FIG. 6 shows a view of the locking mechanism.

Referring now to FIG. 2, FIG. 5, and FIG. 6, the extendable insert 2 further comprises a locking mechanism 26. In the ideal embodiment, the locking mechanism 26 is a latch that comprises a protrusion 261 and a hook 262. The protrusion 261 is located on one segment of the kayak, and the hook 262 on another segment of the kayak—for example, one protrusion 261 may be located on the extendable insert 2, and one hook 262 may be located on the main body 1. Once the kayak is extended, the hook 262 can be placed around the protrusion 261, preventing the kayak from collapsing or extending when in use. The locking mechanism 26 may be indented into the side of the kayak and covered with an external flap 27 to secure the locking mechanism 26 when not in use.

In one embodiment, as seen in FIG. 5, the extendable insert 2 may further comprise a spring-loaded automatic catch 25. The spring-loaded automatic catch 25 is designed to automatically slot into an indent 16 when the extendable insert 2 has been fully extended away from the main body 1. When the catch is slotted into the indent 16, the kayak is more firmly secured in place, allowing the user to more easily secure the locking mechanism 26 as described previously.

Alternate embodiments of the present invention contemplate the use of numerous accessories integrated into the assembly of the kayak. In one embodiment, the extendable insert 2 may further comprise a mounting bracket. The mounting bracket allows users to secure their paddles during use of the invention. In one embodiment, a toggle may be placed in the extendable insert 2, allowing the user to attach a tow rope or similar device to the kayak. In one embodiment, a port may be provided on the side of the main body 1, serving as a versatile attachment points for the user.

In an alternate embodiment, the use of a rail to aid in the telescoping of the extendable inserts 2 is contemplated. The rail would serve to keep the extendable insert 2 more firmly in place and help the user smoothly guide the extendable insert 2 in and out of the main body 1. The rail is located in the main body 1, and the extendable insert 2 is attached or otherwise movably affixed to the rail, allowing it to slide freely along the rail when force is applied.

In an embodiment, when fully extended, the extendable insert 2 or plurality of extendable inserts and the main body 1 form a single, flat bottom 5 for the collapsible kayak.

As seen in the FIG. 1-5, alternate embodiments of the present invention contemplate the use of multiple of the above components. For example, the kayak might comprise one main body 1 but a plurality of extendable inserts 2. In this embodiment, each extendable insert 2 is attached to either the main body 1, or another extendable insert 2. An extendable insert 2 that is telescopically positioned within another extendable insert 2 is hereinafter referred to as a sub insert 4. The sub insert 4 has an insert opening 23 on both sides of the sub insert 4. For example, as seen in FIG. 1, in a kayak having four extendable inserts 2 and one main body 1, there might be a bow-side sub insert 4, a middle bow extendable insert 2 that is connected to both the bow sub insert 4 and the main body 1, and the main body 1. Likewise, the same configuration would be in place on the stern side of the kayak. In this embodiment, each extendable insert 2 that connects to another extendable insert 2 would also contain the lip 17 from the main body 1. This allows the extendable insert 2 to connect to another extendable insert 2 as it would to the main body 1, by sliding out until the lip 17 catches on the ridge 24. The locking mechanism 26 placement is adjusted accordingly, such that each extendable insert 2 has a protrusion 261 and a hook 262 to connect to the next segment of the kayak.

Although the invention has been explained in relation to its preferred embodiment, it is to be understood that many other possible modifications and variations can be made without departing from the spirit and scope of the invention.

What is claimed is:

1. A collapsible kayak comprising:
a main body;
the main body further comprising a top opening, a side opening, a cockpit area, and a lip;
an extendable insert;
the extendable insert further comprising a midsection, an end section, a ridge, an insert opening, and a seal;
the top opening being positioned perimetrically around the cockpit area;
the lip being positioned perimetrically around the side opening of the main body;
the ridge being positioned perimetrically around an interior of the midsection;
the extendable insert being telescopically positioned within the main body, such that the extendable insert extends out of the side opening of the main body; and
the ridge of the extendable insert being positioned to catch on the lip when the extendable insert is fully extended.

2. The collapsible kayak of claim 1, further comprising:
a hatch;
the hatch comprising a hollow enclosure and a lid; and
wherein the hatch is waterproof.

3. The collapsible kayak of claim 1, further comprising:
a locking mechanism;
the locking mechanism further comprising a protrusion and a hook; and
wherein the hook is sized to latch onto the protrusion.

4. The collapsible kayak of claim 3, wherein:
the protrusion is positioned on the main body; and
the hook is positioned on the extendable insert.

5. The collapsible kayak of claim 4, wherein:
an indent is positioned on the main body;
a spring-loaded catch mechanism is positioned on the extendable insert; and
wherein the spring-loaded catch mechanism engages with the indent when the extendable insert is fully extended.

6. The collapsible kayak of claim 5, further comprising:
an external flap; and
the external flap being positioned over the locking mechanism.

7. The collapsible kayak of claim 1, further comprising:
a plurality of extendable inserts, wherein at least one of the plurality of extendable inserts is a sub insert;
each extendable insert of the plurality of extendable inserts further comprising a lip;
the sub insert being positioned telescopically inside one of the plurality of extendable inserts; and
such that the ridge of the sub insert catches on the lip of at least one of the plurality of extendable inserts when the sub insert is fully extended.

8. The collapsible kayak of claim 1, further comprising:
the extendable insert and the main body forming a flat, contiguous bottom when the extendable insert is in an extended position.

9. The collapsible kayak of claim 7, further comprising:
the plurality of extendable inserts and the main body forming a flat, contiguous bottom when the plurality of extendable inserts is in an extended position.

10. A collapsible kayak comprising:
a main body;
the main body further comprising a top opening, a side opening, a cockpit area, and a lip;
an extendable insert;
the extendable insert further comprising a midsection, an end section, a ridge, an insert opening, and a seal;
the top opening being positioned perimetrically around the cockpit area;
the lip being positioned perimetrically around the side opening of the main body;
the ridge being positioned perimetrically around an interior of the midsection;
the extendable insert being telescopically positioned within the main body, such that the extendable insert extends out of the side opening of the main body;
the ridge of the extendable insert being positioned to catch on the lip when the extendable insert is fully extended;
a hatch;
the hatch comprising a hollow enclosure and a lid;
wherein the hatch is waterproof;
a locking mechanism;
the locking mechanism further comprising a protrusion and a hook;
wherein the hook is sized to latch onto the protrusion;
an indent is positioned on the main body;
a spring-loaded catch mechanism is positioned on the extendable insert; and
wherein the spring-loaded catch mechanism engages with the indent when the extendable insert is fully extended.

11. The collapsible kayak of claim 10, wherein:
the protrusion is positioned on the main body; and
the hook is positioned on the extendable insert.

12. The collapsible kayak of claim 11, further comprising:
a plurality of extendable inserts, wherein at least one of the plurality of extendable inserts is a sub insert;
each extendable insert of the plurality of extendable inserts further comprising a lip;
the sub insert being positioned telescopically inside one of the plurality of extendable inserts;
such that the ridge of the sub insert catches on the lip of at least one of the plurality of extendable inserts when the sub insert is fully extended.

13. The collapsible kayak of claim 10, further comprising:
an external flap; and
the external flap being positioned over the locking mechanism.

14. The collapsible kayak of claim 10, further comprising:
the extendable insert and the main body forming a flat, contiguous bottom when the extendable insert is in an extended position.

15. The collapsible kayak of claim 10, further comprising:
the plurality of extendable inserts and the main body forming a flat, contiguous bottom when the plurality of extendable inserts is in an extended position.

16. A collapsible kayak comprising:
a main body;
the main body further comprising a top opening, a side opening, a cockpit area, and a lip;
an extendable insert;
the extendable insert further comprising a midsection, an end section, a ridge, an insert opening, and a seal;
the top opening being positioned perimetrically around the cockpit area;
the lip being positioned perimetrically around the side opening of the main body;
the ridge being positioned perimetrically around an interior of the midsection;
the extendable insert being telescopically positioned within the main body, such that the extendable insert extends out of the side opening of the main body;
the ridge of the extendable insert being positioned to catch on the lip when the extendable insert is fully extended;
a hatch;
the hatch comprising a hollow enclosure and a lid;
wherein the hatch is waterproof;
a locking mechanism;
the locking mechanism further comprising a protrusion and a hook;
wherein the hook is sized to latch onto the protrusion;
an external flap;
the external flap being positioned over the locking mechanism;
an indent is positioned on the main body;
a spring-loaded catch mechanism is positioned on the extendable insert;
wherein the spring-loaded catch mechanism engages with the indent when the extendable insert is fully extended;
the protrusion is positioned on the main body;
the hook is positioned on the extendable insert; and
the extendable insert and the main body forming a flat, contiguous bottom when the extendable insert is in an extended position.

17. The collapsible kayak of claim 16, further comprising:
a plurality of extendable inserts, wherein at least one of the plurality of extendable inserts is a sub insert;
each extendable insert of the plurality of extendable inserts further comprising a lip;
the sub insert being positioned telescopically inside one of the plurality of extendable inserts; and
such that the ridge of the sub insert catches on the lip of at least one of the plurality of extendable inserts when the sub insert is fully extended.

18. The collapsible kayak of claim 17, further comprising:
the plurality of extendable inserts and the main body forming a flat, contiguous bottom when the plurality of extendable inserts is in an extended position.

* * * * *